US006588066B2

(12) United States Patent
Pferdmenges

(10) Patent No.: US 6,588,066 B2
(45) Date of Patent: Jul. 8, 2003

(54) SLIVER-FORMING DEVICE IN A FIBER PROCESSING MACHINE

(75) Inventor: Gerd Pferdmenges, Jüchen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/982,000

(22) Filed: Oct. 19, 2001

(65) Prior Publication Data

US 2002/0046445 A1 Apr. 25, 2002

(30) Foreign Application Priority Data

Oct. 19, 2000 (DE) ..... 100 51 917

(51) Int. Cl.[7] ..... D01G 25/00
(52) U.S. Cl. ..... 19/150; 19/157; 19/98
(58) Field of Search ..... 19/65 A, 65 CR, 19/65 R, 98, 100, 101, 105, 106 R, 108, 112, 150, 157, 200–205, 288; 226/196

(56) References Cited

U.S. PATENT DOCUMENTS

| | | | | | |
|---|---|---|---|---|---|
| 3,339,245 | A | * | 9/1967 | Bryan, Jr. | 19/200 |
| 3,895,417 | A | * | 7/1975 | Zimmerman, Jr. | 19/288 |
| 4,213,553 | A | * | 7/1980 | Leifeld | 226/196 |
| 4,501,048 | A | | 2/1985 | Varga | |
| 5,095,587 | A | * | 3/1992 | Kluttermann et al. | 19/150 |
| 5,461,757 | A | * | 10/1995 | Leifeld | 19/150 |
| 6,151,760 | A | * | 11/2000 | Weber | 19/157 |
| 6,223,398 | B1 | * | 5/2001 | Leifeld | 19/98 |

FOREIGN PATENT DOCUMENTS

| | | |
|---|---|---|
| DE | 817 707 | 10/1951 |
| DE | 15 10 487 | 3/1971 |
| DE | 23 58 941 | 6/1975 |
| DE | 25 21 481 | 11/1975 |
| DE | 38 39 413 | 5/1990 |
| DE | 93 20 353 | 10/1994 |
| DE | 195 28 484 | 2/1997 |
| DE | 39 13 548 | 8/2000 |
| JP | 05-117920 | 5/1993 |
| SE | 580 174 | 9/1976 |
| WO | 99/22053 | 5/1999 |

* cited by examiner

*Primary Examiner*—Gary L. Welch
(74) *Attorney, Agent, or Firm*—Venable; Robert Kinberg; Stuart I. Smith

(57) ABSTRACT

A fiber processing machine includes an arrangement for producing a running fiber web having a width extending perpendicularly to the running direction; a roll unit having a roll axis and a roll surface engaging the running web; a web guiding element disposed downstream of the roll unit for laterally gathering the web for reducing the width thereof; and a web trumpet disposed downstream of the web guiding element. The web trumpet has an outlet opening for discharging the running web. The outlet opening has an outlet height and an outlet width greater than the outlet height. The outlet width is oriented to the roll axis at an angle other than zero for reorienting the width of the web during run thereof from the roll unit to the outlet opening. A calender roll pair is disposed downstream of the web trumpet.

20 Claims, 6 Drawing Sheets

SLIVER-FORMING DEVICE IN A FIBER PROCESSING MACHINE

CROSS REFERENCE TO RELATED APPLICATION

This application claims the priority of German Application No. 100 51 917.2 filed Oct. 19, 2000, which is incorporated herein by reference.

BACKGROUND OF THE INVENTION

This invention relates to a fiber processing machine such as a carding machine or a roller card unit and is more particularly directed to a sliver forming device including a roll unit and a web trumpet followed by calender rolls. The roll unit may be, for example, a doffer, a stripping roll and/or crushing rolls. The web trumpet receives the web and densifies it to form a sliver which then passes through a calender roll pair. Between the roll unit and the web trumpet a web guiding element is arranged which has an approximately triangular configuration.

U.S. Pat. No. 3,339,245 describes an arrangement in a carding machine where a shaping or folding section is arranged after the doffer. The section is composed of two serially arranged web trumpets between which a pressing roll pair is disposed. The doffer, the web trumpets and the pressing roll pair are each spaced from one another. The axis of the doffer and the pressing rolls are oriented parallel to one another. The width of the outlet of the web trumpet is greater than its height; the long, wide axis of the discharge region is parallel to the axes of the doffer and the pressing rolls. The wide, thin fiber web taken off the doffer passes through the first web trumpet which halves the original web width by folding flanking web portions over the central half width of the web. After the thus-thickened web exits the first web trumpet, it passes through the nip of the pressing roll pair to press the web flat. As the material is discharged by the pressing roll pair, its width is approximately one-half and its thickness approximately twice the fiber web as it was taken off the doffer. Thereafter, the fiber web passes through a second web trumpet which again halves the width of the web. The web reduced in this manner which exits the second trumpet as a strip, is stronger than the original web which was densified into a narrower and thicker strip. The web taken off the doffer has a number of folds (transverse waves) along its width due to the triangular gathering of the running web in the direction of the web trumpet. At the outlet of the trumpet, because of the small outlet height, the folds are compressed from above while the folds are laterally only gathered because of the large outlet width of the trumpet. In the nip of the subsequent pressing rolls the folds are fully crushed in the direction of their amplitude (height direction). It is a disadvantage of such a prior art arrangement that it is complex and expensive and furthermore, a deliberate guidance of the web upstream of and in the web trumpets is not provided so that a disturbance-free, secure introduction into the web trumpets is not possible. It is a further drawback that the web strip discharged by the first web trumpet and the pressing roll pair as well as the web strip discharged by the second web trumpet have a substantially weakened strength in the central regions. As a result, the strip disadvantageously tears in the longitudinal center during further processing in case outwardly directed forces are applied to the edges of the material. Such irregularities are particularly troublesome when the strip constitutes an initial or intermediate product for final products such as articles of hygiene.

SUMMARY OF THE INVENTION

It is an object of the invention to provide an improved device of the above-outlined type from which the discussed disadvantages are eliminated and which, in particular, is structurally simple and makes possible the making of sliver having a significantly more uniform fiber distribution and increased strength.

This object and others to become apparent as the specification progresses, are accomplished by the invention, according to which, briefly stated, the fiber processing machine includes an arrangement for producing a running fiber web having a width extending perpendicularly to the running direction; a roll unit having a roll axis and a roll surface engaging the running web; a web guiding element disposed downstream of the roll unit for laterally gathering the web for reducing the width thereof; and a web trumpet disposed downstream of the web guiding element. The web trumpet has an outlet opening for discharging the running web. The outlet opening has an outlet height and an outlet width greater than the outlet height. The outlet width is oriented to the roll axis at an angle other than zero for reorienting the width of the web during run thereof from the roll unit to the outlet opening. A calender roll pair is disposed downstream of the web trumpet.

As a result of the measures according to the invention, a sliver having a significantly more uniform fiber distribution over its cross section may be obtained. The sliver has a greater strength in the transverse direction and thus better resists laterally outwardly directed forces. It is a particular advantage of the invention that, in contrast to known arrangements, a relocation of the separating location of the strip from the middle of the width to the middle of its thickness is achieved. Also, by virtue of the invention, a higher output speed is feasible and a processing of fiber material with a higher short-fiber proportion is possible.

DESCRIPTION OF THE PREFERRED EMBODIMENTS

Figure 1:
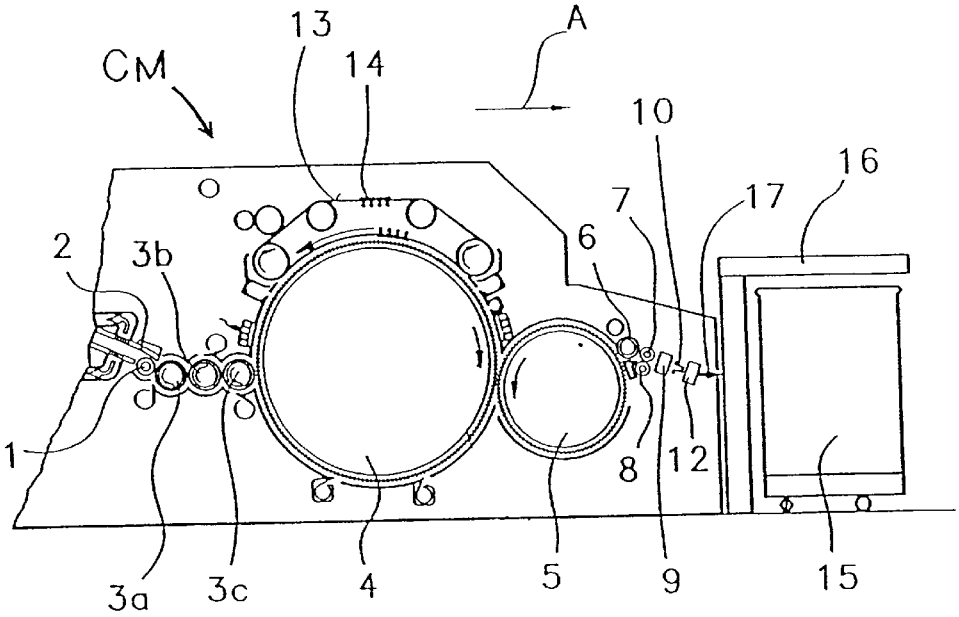
FIG. 1 is a schematic side elevational view of a carding machine incorporating the invention.

FIG. 1 shows a carding machine CM which may be, for example, a high-performance DK 903 model, manufactured by Trvtzschler GmbH & Co. KG, Monchengladbach, Germany. The carding machine CM has a feed roller 1, a feed table 2 cooperating therewith, licker-ins 3*a,* 3*b,* 3*c,* a main carding cylinder 4, a doffer 5, a stripping roll 6, crushing rolls 7, 8, a web guiding element 9, a web trumpet 10, a calender roll pair, of which only roll 12 is visible in FIG. 1, and a traveling flats assembly 13 having slowly circulating flat bars 14. The working direction of the card, that is, the direction of material advance is designated at A. At the output end of the carding machine CM a sliver coiler 16 is provided which deposits the sliver into a coiler can 15.

Figure 2:
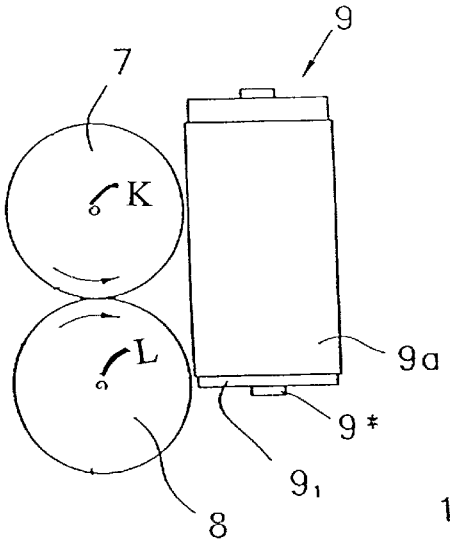
FIG. 2 is an enlarged schematic side elevational view of a part of the FIG. 1 construction.

FIG. 2 is an enlarged detail of FIG. 1, showing the transverse web removal (web guiding) assembly 9 arranged downstream of the crushing rolls 7, 8. The crushing rolls 7 and 8 have respective rotary axes K and L.

Figure 3:
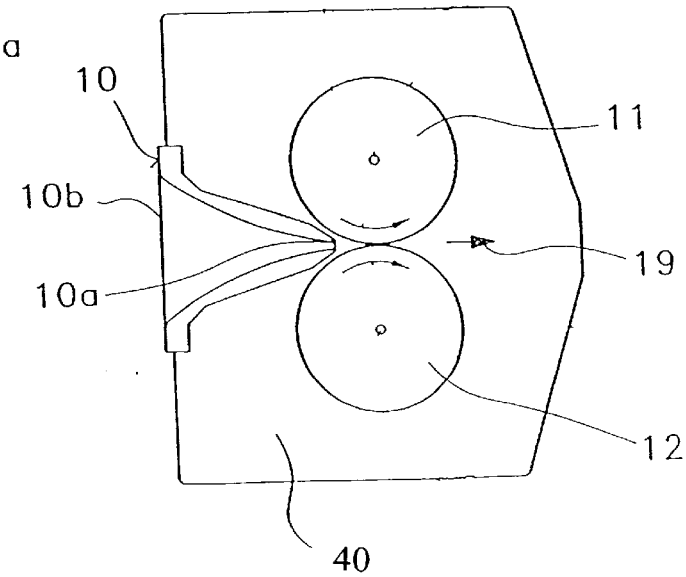
FIG. 3 is an enlarged schematic side elevational view of another part of the FIG. 1 construction.
Figure 4:
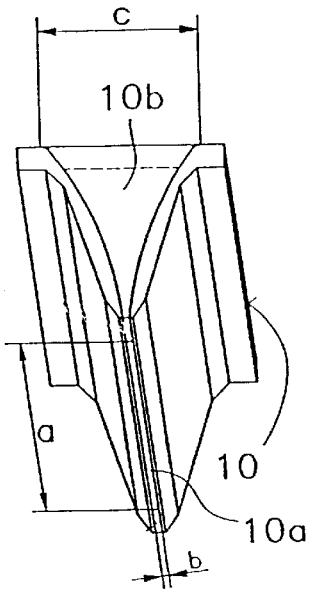
FIG. 4 is a perspective view of a component shown in FIG. 3.
Figure 5A:
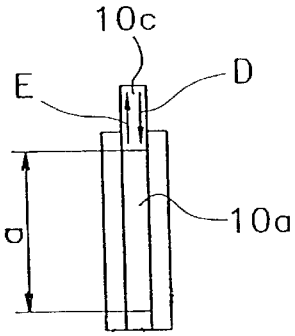
FIG. 5*a* is a partial front elevational view of the structure shown in FIG. 4, illustrating further details.
Figure 5B:
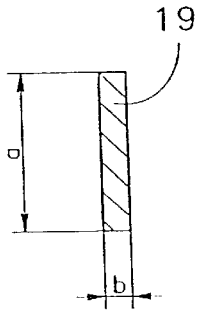
FIG. 5*b* is a cross-sectional view of a sliver.

Turning to FIGS. 3 and 4, the web trumpet 10 and the calender rolls 11, 12 are secured to a holding device 40. The height c of the trumpet input opening lob is greater (for example, five to thirty times) than the height b of the trumpet output opening 10*a*. The height b may be approximately 2–3 mm. The width a of the trumpet outlet opening 10*a* is at least approximately 20–30 mm, preferably 60–90 mm. The width a may be varied according to FIG. 5*a* by providing a wall element 10*c* in the region of the outlet opening 10*a* which is shiftable in the direction of the arrows D, E. The rectangular region 10*a* has sharp edges and, as a result, the flat sliver 19 has a sharp-edged, rectangular cross-sectional outline as illustrated in FIG. 5*b.*

Figure 6A:
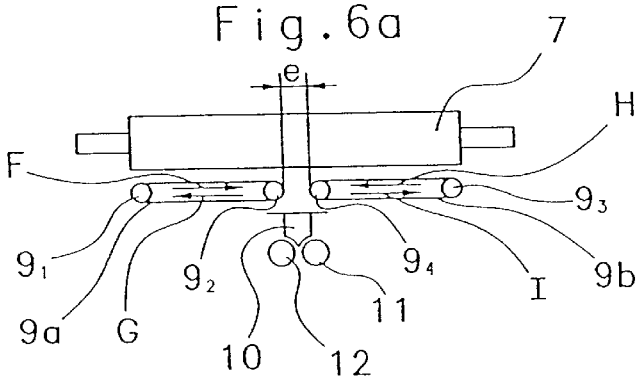
FIG. 6*a* is a schematic top plan view of a web gathering and sliver forming arrangement according to the invention.
Figure 6B:
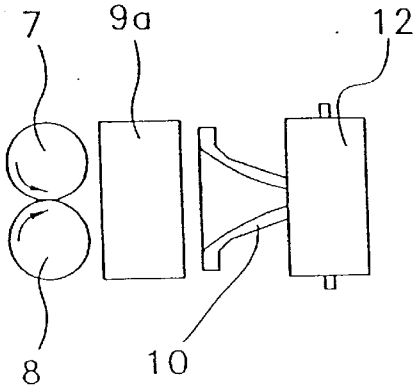
FIG. 6*b* is a schematic side elevational view of the arrangement shown in FIG. 6*a*.
Figure 6C:
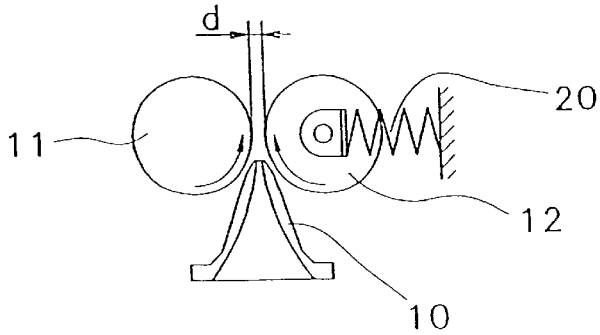
FIG. 6*c* is a schematic top plan view of one part of the structure of FIG. 6*b*, showing a roll support.

As seen in FIGS. 6*a,* 6*b,* 6*c* and also reverting to FIG. 2, downstream of the axially parallel crushing rolls 7, 8 there are arranged the transverse web removal device 9, the web trumpet 10 and the calender rolls 11, 12. The transverse web removal device 9 has two endless conveyor belts 9*a,* 9*b* supported by respective end rolls $\mathbf{9}_1$, $\mathbf{9}_2$ and $\mathbf{9}_3$, $\mathbf{9}_4$, respectively. Of the end roller pairs, one end roller, for example, end rollers $\mathbf{9}_1$ and $\mathbf{9}_3$ are driven via a shaft 9* by a non-illustrated, preferably common drive. The belts 9*a,* 9*b* circulate in the direction of arrows F, G and H, I. The calender roll 12 is radially movably supported and biased by a spring 20 in the direction of the radially stationarily supported calender roll 11 so that the width d of the nip between the calender rolls 11, 12 and thus the pressure on the fiber material may be adjusted. It is noted that in case a doubling of the fiber material prior to further processing is performed, then a substantial pressing force may be damaging whereas in case a direct further processing follows after the carding machine, then a substantial pressing force is desirable.

Figure 7:
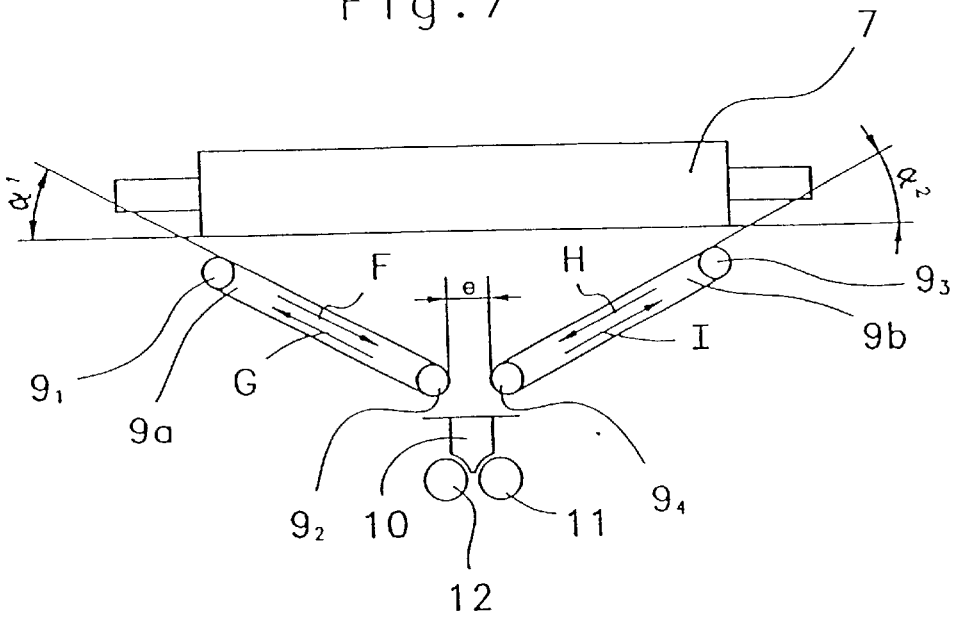
FIG. 7 is a schematic top plan view of a variant of the FIG. 6*a* arrangement.

According to FIG. 7, the conveyor belts 9*a,* 9*b* are arranged at an angle $\alpha_1$ and $\alpha_2$=47° with respect to the axes of the crushing rolls 7 and 8 (only the crushing roll 7 is visible in FIG. 7). As a result, the fiber material discharged by the crushing rolls 7, 8 is guided in the direction F, H towards the clearance e defined between the end rollers $\mathbf{9}_2$ and $\mathbf{9}_4$.

Figure 8:
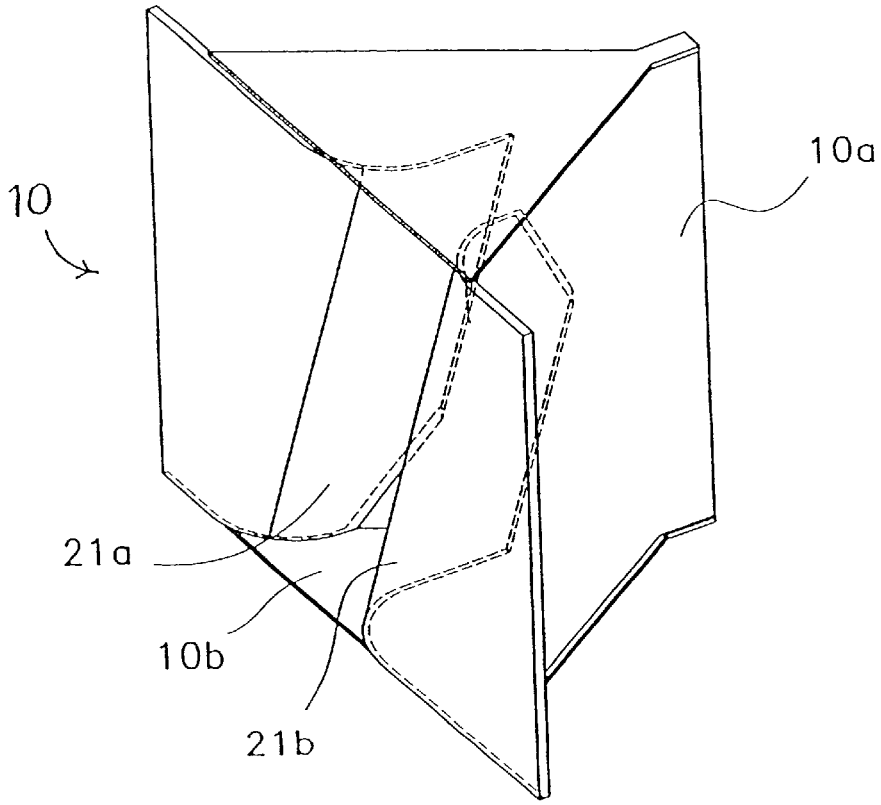
FIG. 8 is a perspective view of a variant of the component shown in FIG. 4.
Figure 9A:
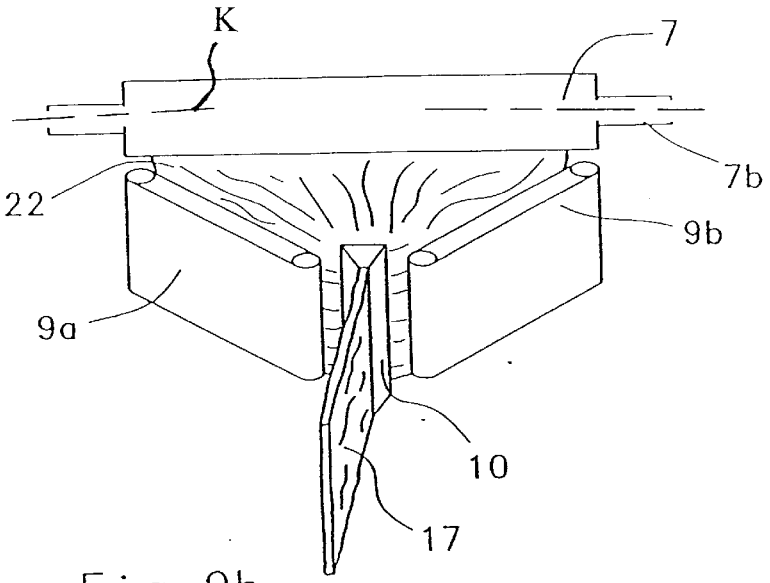
FIG. 9*a* is a perspective view of one part of the construction shown in FIG. 7, schematically showing the flow of the fiber material.
Figure 9B:
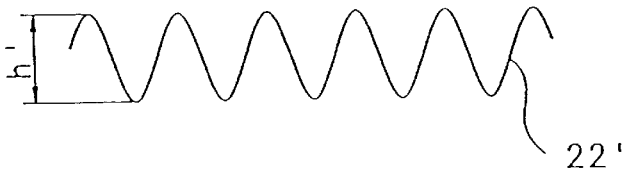
FIG. 9*b* is a diagram illustrating the fold formation of the web discharged by the crushing rolls.
Figure 9C:
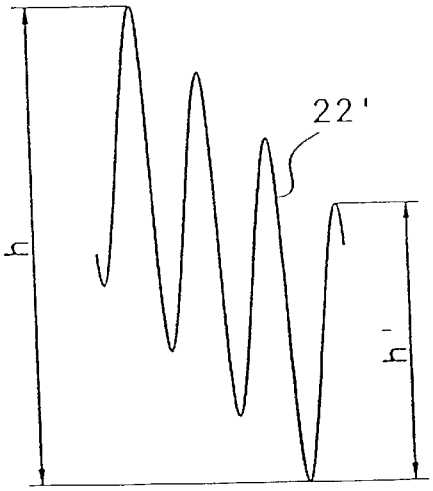
FIG. 9*c* is a diagram illustrating the fold formation of the web entering the web trumpet.
Figure 9D:
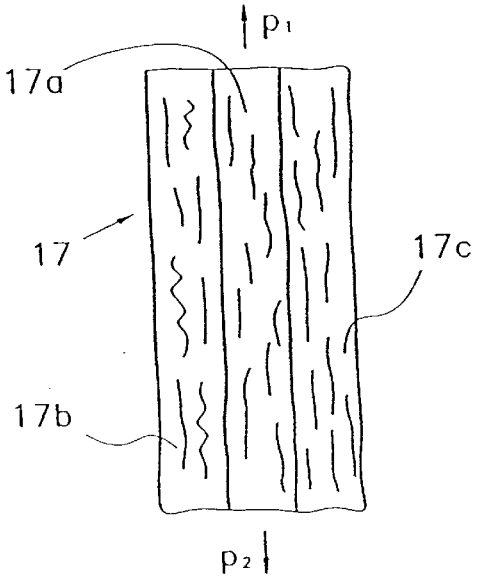
FIG. 9*d* is a cross-sectional view of the sliver discharged by the web trumpet arranged according to the invention.

Turning to FIG. 8, within the trumpet 10, inwardly of the trumpet inlet 10*b,* two guide elements 21*a* and 21*b* are provided, by means of which the web, running toward the trumpet outlet 10*a,* is reoriented by about 90°, so that the plane of the web changes from a substantially horizontal position in front of the inlet opening 10*b* into a vertical position after the outlet opening 10*a* as schematically shown in FIG. 9*a.* The web portion 22 has, from the crushing rolls 7, 8 to the trumpet inlet 10*b* a cross-sectionally wavy configuration composed of waves 22' having a wave amplitude h' of as illustrated in FIG. 9*b.* According to the invention, these web waves are caused to converge and thus to densify laterally and in the working direction and, as shown in FIG. 9*c,* are layered and offset in the vertical direction and have a maximum height h. As a result, as seen in FIG. 9*d,* the cross-sectionally rectangular sliver 17 exiting the web trumpet 10 is thinner in the middle 17*a* than in the two lateral zones 17*b* and 17*c.* This results in a stronger resistance of the sliver 17 against transverse forces $p_1$ and $p_2$.

Figure 10:
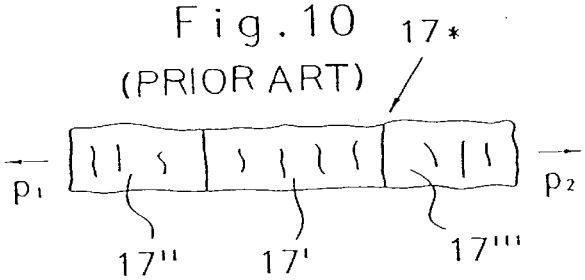
Fig.10 (PRIOR ART)
FIG. 10 is a cross-sectional view of the sliver discharged by a web trumpet oriented parallel to the roll assembly according to the prior art.

If, in contrast, according to prior art arrangements, the width a of the trumpet outlet 10*a* were parallel to the crushing rolls 7, 8 and the conveyor belts 9*a,* 9*b,* the central, thinner region of the web 22 would, according to FIG. 10, appear as the middle zone 17' in the sliver 17* flanked by two thicker regions 17" and 17'". Thus, if two transverse forces $p_1$ and $p_2$ were applied, the sliver 17* would tear easier in the region 17', that is, it would be much less resistant than the sliver 17 illustrated in FIG. 9*d.*

Figure 11:
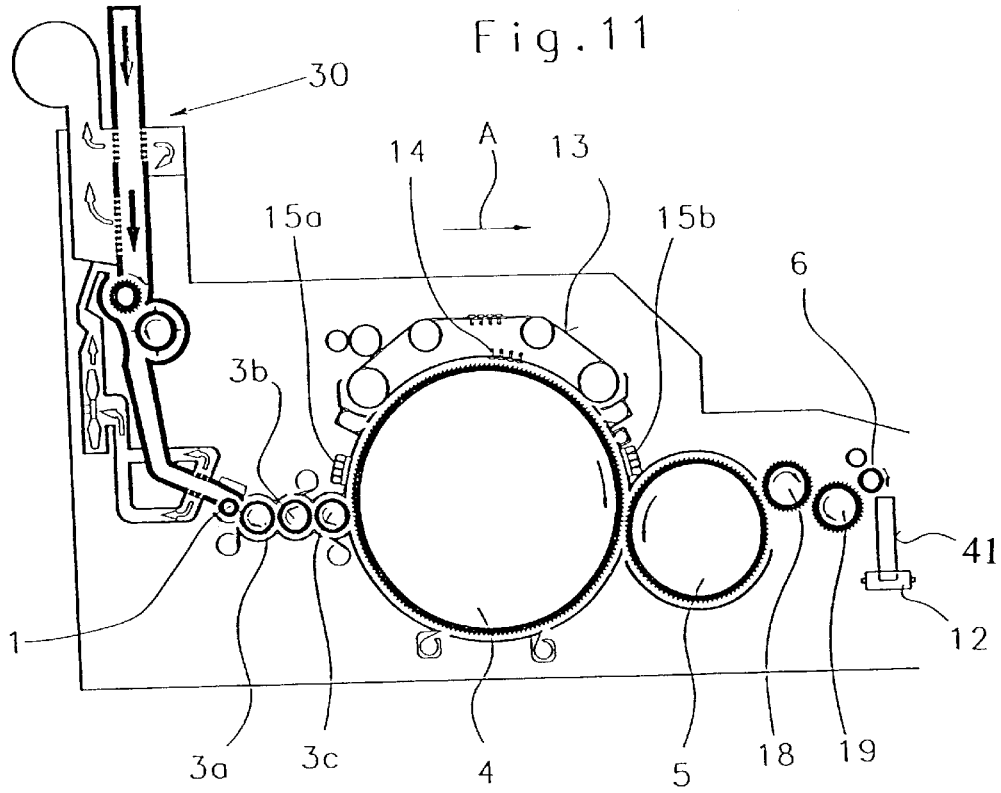
FIG. 11 is a schematic side elevational view of a carding machine incorporating the invention including two shoving rolls and a stripping roll.

FIG. 11 shows a carding machine similar to FIG. 1 which is supplied with a fiber lap by a card feeder 30 and which has, between the doffer 5 and the stripping roll 6, two shoving rolls 18 and 19 for accumulating the fiber material to produce a heavy web. As the stripping roll 6 rotates, it throws the fiber material into a web gathering element 41.

Figure 12:
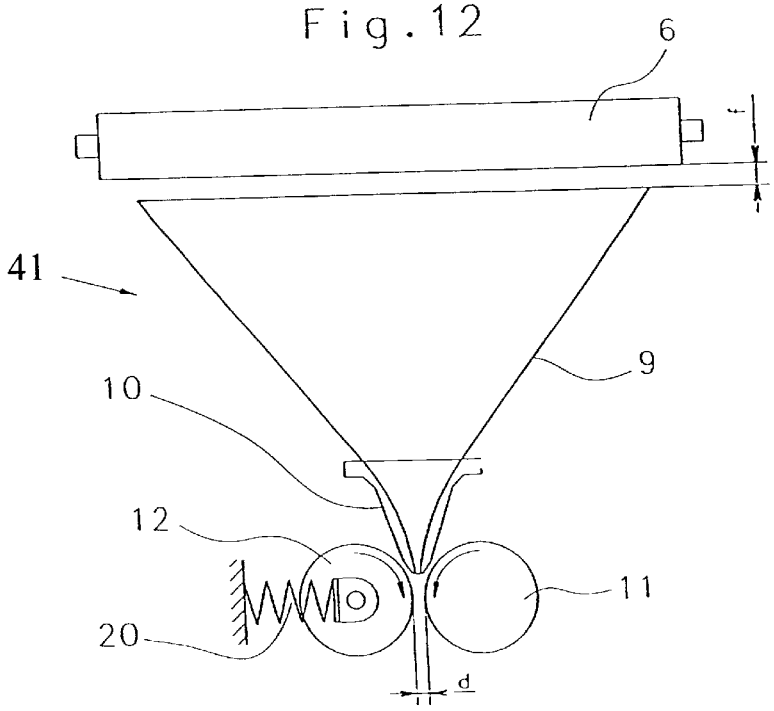
FIG. 12 is a schematic front elevational view of the invention in a two-part construction.
Figure 13:
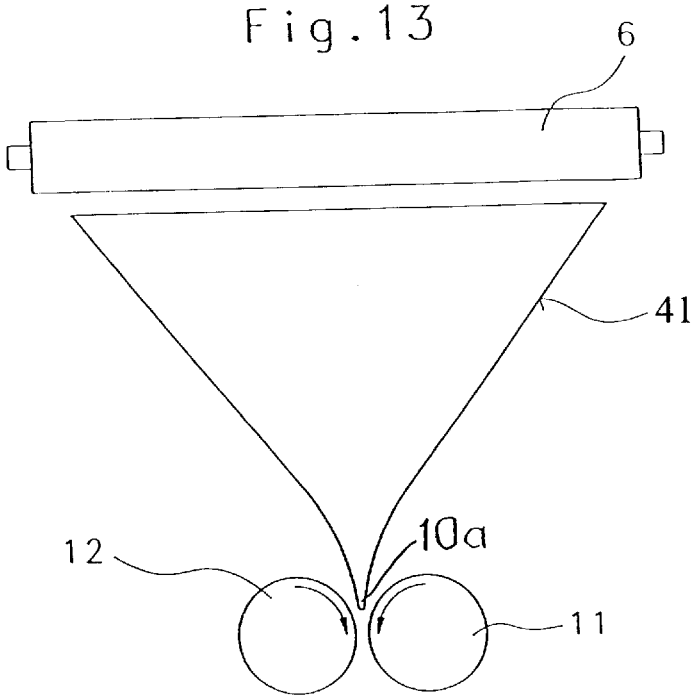
FIG. 13 is a view similar to FIG. 12, showing a one-part construction of the invention.

The web gathering element 41 has, as shown in FIGS. 12 and 13, a web gathering region and a web densifying region as seen in the direction of material advance. According to FIG. 12, the web gathering element 41 is formed by a web guiding element 9 which constitutes the web gathering region and a web trumpet 10 which forms the web densifying region. The web guiding element 9 and the web trumpet 10 are closed on all sides except for the respective inlet and outlet openings for the fiber material. The inlet opening of the web guiding element 9 is arranged at a distance f (for example, approximately 50 mm) from the stripping roll 6.

As seen in FIG. 13, the web gathering element 41 is one-piece structure. The outlet of the web gathering element 41 corresponds to the trumpet outlet 10*a* and is situated within the bight defined between the calender rolls 11, 12.

All the wall surfaces of the web gathering element 41, both in the configuration of FIG. 12 and also according to FIG. 13, are immovable during operation, that is, the fiber material glides on the inner wall faces of the web guiding element 41.

Figure 14:
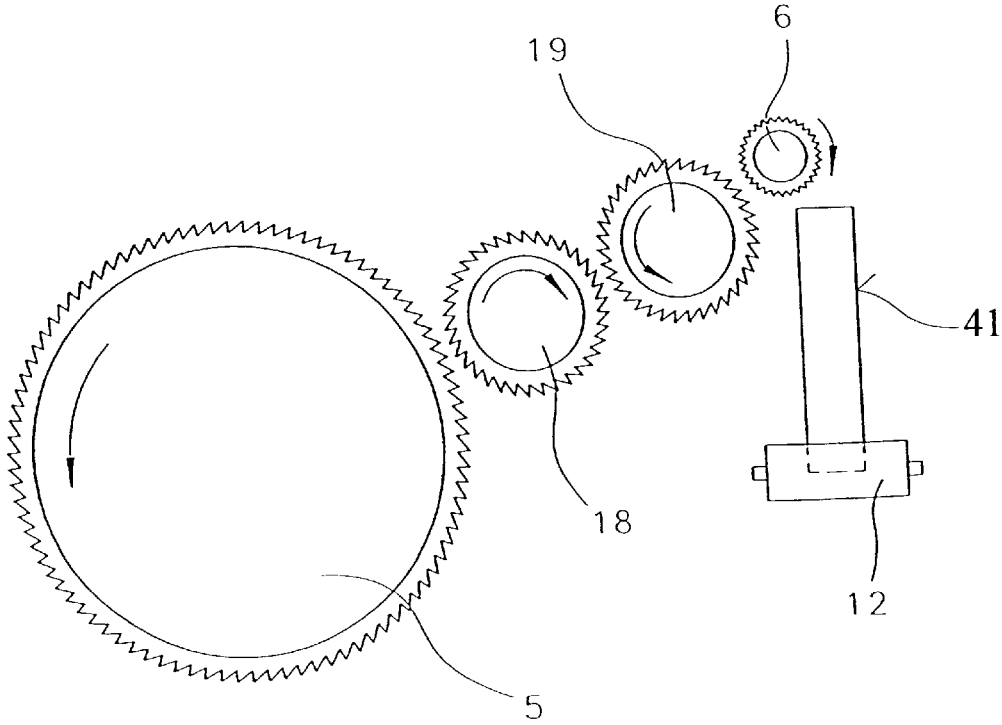
FIG. 14 is a schematic side elevational view showing, in series and at consecutively higher height levels, a doffer, two shoving rolls and a stripping roll.

As seen in FIG. 14, the shoving rolls 18 and 19 and the stripping roll 6 are at increasing height levels whereby the fiber material is lifted to a certain height. By virtue of such an arrangement the web gathering element 41 may be arranged underneath the stripping roll 6 so that gravity aids the raised web material to drop into the web gathering element 41 to thus support the flow of material. The calender rolls 11, 12 pull the densified sliver 17 (FIGS. 9*a*, 9*d*) from the outlet opening of the web gathering element 41.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) means for producing a running fiber web having a running direction and a width extending perpendicularly to said running direction;

(b) a roll unit having a rotary roll axis and a roll surface engaging the running web;

(c) a web guiding element disposed downstream of said roll unit as viewed in said running direction for laterally gathering the web for reducing the width thereof;

(d) a web trumpet disposed downstream of said web guiding element; said web trumpet having an inlet opening for receiving the running web and an outlet opening for discharging the running web; said outlet opening having an outlet height and an outlet width greater than said outlet height; said outlet width being oriented to said roll axis at an angle other than zero for reorienting the width of the web during run thereof from said roll unit to said outlet opening; and (e) a calender roll pair disposed downstream of said web trumpet; the running web passing through said calender roll pair after being discharged by said outlet opening of said web trumpet.

2. The fiber processing machine as defined in claim 1, wherein said angle is 90°.

3. The fiber processing machine as defined in claim 1, wherein said width of said outlet opening is at least ten times greater that said height of said outlet opening.

4. The fiber processing machine as defined in claim 1, wherein said width of said outlet opening is at least thirty times greater that said height of said outlet opening.

5. The fiber processing machine as defined in claim 1, wherein said outlet opening of said web trumpet has sharp edges.

6. The fiber processing machine as defined in claim 1, wherein said calender rolls define a bight and further wherein said outlet opening of said web trumpet is situated in said bight.

7. The fiber processing machine as defined in claim 1, further comprising means for radially displaceably supporting one of said calender rolls and a spring for resiliently urging said calender rolls to one another.

8. The fiber processing machine as defined in claim 1, wherein each said calender roll has a rotary axis oriented at an angle other than zero to said roll axis of said roll unit.

9. The fiber processing machine as defined in claim 1, wherein said inlet opening of said web trumpet is elongated.

10. The fiber processing machine as defined in claim 1, further comprising a slidable wall element supported by said web trumpet for varying said width of said outlet opening.

11. The fiber processing machine as defined in claim 1, further comprising a guide element disposed in said web trumpet for guiding the running web inside said web trumpet toward said outlet opening thereof.

12. The fiber processing machine as defined in claim 1, wherein said web guiding element and said web trumpet constitute a one-piece structure.

13. The fiber processing machine as defined in claim 1, wherein said web guiding element and said web trumpet are situated below said roll unit.

14. The fiber processing machine as defined in claim 1, wherein said web guiding element and said web trumpet are disposed generally vertically below one another.

15. The fiber processing machine as defined in claim 1, wherein said calender rolls are positioned below said web trumpet.

16. The fiber processing machine as defined in claim 1, wherein said roll unit has an axial length and said web guiding element has an inlet zone; said inlet zone extending over said axial length of said roll unit.

17. The fiber processing machine as defined in claim 1, wherein said web guiding element has an inlet zone adjoining said roll unit.

18. The fiber processing machine as defined in claim 1, wherein said roll unit comprises a doffer, a stripping roll positioned downstream of said doffer and a shoving roll positioned between said doffer and said stripping roll.

19. The fiber processing machine as defined in claim 1, wherein said roll unit comprises a doffer, a stripping roll positioned downstream of said doffer and a plurality of serially arranged shoving rolls positioned between said doffer and said stripping roll; said shoving rolls and said stripping roll are arranged at increasing height levels with respect to one another.

20. The fiber processing machine as defined in claim 1, wherein said width of said outlet opening is at least five times greater that said height of said outlet opening.

* * * * *

UNITED STATES PATENT AND TRADEMARK OFFICE

CERTIFICATE OF CORRECTION

PATENT NO. : 6,588,066 B2
DATED : July 8, 2003
INVENTOR(S) : Gerd Pferdmenges

It is certified that error appears in the above-identified patent and that said Letters Patent is hereby corrected as shown below:

Title page,
Item [75], Inventor, "Gerd Pferdmenges" should read
-- [75] Inventors: Gerd Pferdmenges
Gregor Eschenbruch --

Signed and Sealed this

Eleventh Day of November, 2003

JAMES E. ROGAN
*Director of the United States Patent and Trademark Office*